US007861437B2

(12) United States Patent
Solomon-Gunn et al.

(10) Patent No.: US 7,861,437 B2
(45) Date of Patent: Jan. 4, 2011

(54) SYSTEM AND METHOD FOR MIXING DISTINCT AIR STREAMS

(75) Inventors: Margaret E. Solomon-Gunn, Gorham, ME (US); Laurent R. Parent, Veazie, ME (US); Lynn C. Cotta, Scarborough, ME (US)

(73) Assignee: Metso Paper USA, Inc., Biddeford, ME (US)

( * ) Notice: Subject to any disclaimer, the term of this patent is extended or adjusted under 35 U.S.C. 154(b) by 544 days.

(21) Appl. No.: 11/363,406

(22) Filed: Feb. 27, 2006

(65) Prior Publication Data

US 2007/0199202 A1 Aug. 30, 2007

(51) Int. Cl.
*F26B 5/04* (2006.01)
*F26B 3/00* (2006.01)

(52) U.S. Cl. ..... 34/629; 34/638; 34/639; 34/218; 34/219

(58) Field of Classification Search ..... 34/218, 34/219, 231, 478, 479, 629, 638, 639, 640
See application file for complete search history.

(56) References Cited

U.S. PATENT DOCUMENTS

| | | | | |
|---|---|---|---|---|
| 2,210,032 | A | 8/1940 | Hess et al. | |
| 2,498,506 | A * | 2/1950 | Ramser | 250/576 |
| 3,303,576 | A | 2/1967 | Sisson | |
| 4,074,441 | A | 2/1978 | Helversen et al. | |
| 4,103,434 | A | 8/1978 | Walker | |
| 4,133,636 | A * | 1/1979 | Flynn | 34/636 |
| 4,146,361 | A | 3/1979 | Cirrito et al. | |
| 4,270,283 | A | 6/1981 | Ellis | |
| 4,328,626 | A | 5/1982 | Leitner | |
| 4,443,185 | A | 4/1984 | Smith | |
| 4,457,087 | A | 7/1984 | Wolff et al. | |
| 4,481,722 | A | 11/1984 | Guy et al. | |
| 4,881,327 | A | 11/1989 | Hauser et al. | |
| 5,579,072 | A * | 11/1996 | Frank et al. | 34/640 |
| 5,625,962 | A | 5/1997 | Fleissner | |
| 5,692,371 | A * | 12/1997 | Varshay et al. | 60/221 |
| 5,784,801 | A | 7/1998 | Thorp et al. | |
| 5,974,691 | A | 11/1999 | Marchal et al. | |
| 6,071,006 | A | 6/2000 | Hochstein et al. | |

(Continued)

FOREIGN PATENT DOCUMENTS

| | | | |
|---|---|---|---|
| GB | 2395887 | A | 6/2004 |

*Primary Examiner*—Jiping Lu
(74) *Attorney, Agent, or Firm*—Pierce Atwood LLP; Kevin M. Farrell; Katherine A. Wrobel

(57) ABSTRACT

The present invention relates to novel dryer systems that incorporate two-stage processes for heating air for drying a traveling web. The present invention is operable within a drying system having a drying hood containing a dryer. The drying hood receives heated air through an intake and expels system air through an exhaust. The portion of system air that is maintained in the system is divided into two portions and directed into separate parallel conduits for two-stage heating that results in greater temperature uniformity and efficiency within the system. One loop includes a mixing chamber for the initial mixing of system air with the combustion products of a burner. A second loop includes an injection chamber that receives the initially mixed air and injects it into the other portion of the system air, resulting in greater temperature uniformity within the drying hood and increased operating efficiency for the entire system.

21 Claims, 9 Drawing Sheets

U.S. PATENT DOCUMENTS 6,303,003 B1 10/2001 Webster
6,378,226 B1 4/2002 Fleissner
6,551,461 B2 4/2003 Hermans et al.
6,869,506 B2 3/2005 Jewitt
6,910,283 B1 6/2005 Reddy
6,953,516 B2 10/2005 Hermans et al.
6,977,028 B2 * 12/2005 Ross et al. ..... 34/114
2004/0099393 A1 5/2004 Jewitt

* cited by examiner

SYSTEM AND METHOD FOR MIXING DISTINCT AIR STREAMS

BACKGROUND OF THE INVENTION

1. Field of the Invention

The present invention relates generally to the field of fluid dynamics and heat transfer, and more specifically to a system and method for mixing fluid streams within an industrial drying machine.

2. Description of the Prior Art

Industrial machines, such as those common in the textile, nonwovens and paper manufacturing industries, commonly utilize heated air to dry a newly formed product, as well for thermal bonding, curing and other processes that require an air stream with a uniform temperature profile. Typically, air is heated through conventional combustion means and then directed in various fashions towards the web of wet material. The heated air passes through or impinges the web, losing some of its heat in the drying process. The cooled air, referred to as system air, is then divided into portions that are re-circulated through the drying machine and portions that are exhausted into the atmosphere.

Drying machines in the aforementioned industries are generally of three types: through-air-dryers (TAD), impingement dryers, or floatation dryers. Each of these types of dryers is typically contained within a drying hood, which supplies and directs heated air to the surface of the web. A vacuum or pressure differential pulls the heated air through or onto the surface of the web and exhausts the cooled air into the system at large, at which point a portion of the cooled air will be exhausted into the atmosphere while the remainder is reused for drying applications. The direction of travel of the web is referred to as the machine direction, and the direction perpendicular to the machine direction and coplanar with the web is referred to as the cross-machine direction.

A typical dryer system 100 is shown in FIG. 1. As noted, the system 100 includes a dryer 110 that is partially surrounded by a dryer hood 112, through which air is drawn from the surrounding structures. A web of goods enters the hood 110 on the wet end 114 and proceeds through the dryer 110, where heated air is drawn through it, to the dry end 116. The heated air is pushed in through an intake 118 and is drawn out of an exhaust 120 by a main fan 122 which drives partially closed circuit as shown in FIG. 1. A portion of the system air is exhausted into the atmosphere through duct 124.

The remaining system air is directed to an air heater 126 that combines the system air with combustion products from a burner 128. The burner 128 is driven by a combustion air source 130, such as a fan, and fuel 132. The mixed air 134 is a combination of combustion products and system air that will be used to dry the web passing through the dryer hood 112. Those skilled in the art will recognize that the combination of the system air and the combustion products will not necessarily produce a uniformly profiled stream of heated air. On the contrary, the introduction of a secondary stream of combustion products into the system air may produce non-homogenous profile for the mixed air 134. As a result, a typical dryer system 100 generally incorporates a static mixer 136 for inducing turbulence and mixing into the mixed air 134 stream so as to maximize thermal uniformity prior to entering the drying hood.

The foregoing example demonstrates both the strengths and weaknesses of the state of the art heating systems. While the current art is able to make remarkable use of system air through the re-circulation mechanisms, the necessary mixing of that air with combustion products is potentially hazardous to the end product. An essential aspect of textile and paper manufacturing is that the air that is drawn through or impinged upon the product must have a substantially uniform temperature profile along the cross-machine direction. Particularly for the manufacture of lightweight materials, such as tissue paper, any deviation in the temperature profile can irreversibly damage the finished product. The economic effects of non-uniform heating are multiple, including the energy required to replace the lost product, the costs of replacing the wasted raw materials, and the labor necessary to fix, maintain, manage and operate the dryer through a new production cycle. As such, one of the paramount concerns in the paper industry is designing a dryer that reliably maintains a uniform temperature profile in the cross-machine direction.

As noted above, it is common practice to re-circulate spent system air and reuse it in the drying cycle. Typically, the system air is combined with newly heated air and then the air is mixed as it passes through the machine ductwork towards the web of goods. Although the industry has made several attempts at efficiently re-circulating the air exhausted through the roll, the current state of the art requires a significant distance between the mixing point and the web in order to ensure that the temperature profile of the mixed stream is sufficiently homogenous.

For example, attempts have been made to introduce a heated fluid stream into a cooler fluid stream by using a baffling structure. Such a mechanism was contemplated in the invention described in international publication WO/0012202 published on Mar. 9, 2000. Although that invention describes a mechanical means for inducing turbulence, and hence mixing, in the combination of two fluid streams, it still does not do so with optimal efficiency of space and energy. In particular, the baffle design does create a large eddy that induces mixing of the fluid streams, but it does not do so in a symmetrical or uniform manner. Thus, the designers must either remix the turbulent air with a second device such as a static mixer; or alternatively, they must maximize the distance between the baffle location and the intake into the drying hood. Each of these two solutions involves non-trivial modifications to the drying systems described above, and both solutions would cost the producer in terms of energy efficiency and space utilization.

Given the foregoing, it is readily apparent to those skilled in the art that there is a need for a system and method for mixing fluid streams that is compact, energy efficient and produces a reliably uniform temperature profile across the web. Moreover, there is a need in the art for solutions that can be easily integrated into current drying system design without greatly expanding the hardware and space necessary to manufacture textiles. Lastly, there is a need in the art for a drying system that will minimize energy expenditures while deriving the greatest benefits from the raw materials processed therein.

SUMMARY OF THE INVENTION

Accordingly, the present invention relates to a novel drying system that incorporates two-stage processes for heating air for drying a traveling web. In its various embodiments, the present invention operates within a system having a drying hood containing a dryer. The drying hood receives heated air through an intake and expels system air through an exhaust, a portion of which is directed into the atmosphere. In one embodiment, the portion of system air that is maintained in the system is divided into two portions and directed into separate parallel loops for two-stage heating that results in greater temperature uniformity and efficiency within the drying system.

The first portion of the system air is directed into a first conduit, and the second portion of the system air is directed into a second conduit. The first conduit includes an injection chamber that is disposed serially, or incorporated into, the drying hood intake. The second conduit includes a mixing chamber that is coupled to a burner for heating the air within the system.

The mixing chamber includes an arrangement of passages that effectively and efficiently mix the second portion of the system air with the combustion products from the burner. This mixed air stream is directed towards the injection chamber, where an injector or series of injectors induce further mixing by injecting the mixed air stream into the first portion of the system air. The injection chamber can also be integrated into the drying hood and controlled in such a manner so as to provide homogenous or non-homogenous air temperature across the running web, as determined by the user and the particular drying application.

By dividing the heating process into two stages, the present invention greatly increases the drying efficiency of a drying system. Notably, although one embodiment of the present invention utilizes a pair of distinct conduits for the heating process, the physical size of the drying system will not be affected. On the contrary, because of the increased mixing and heating efficiency of the present invention, it is possible to construct a drying system that is both smaller in size and more energy efficient that those presently used in the industry. Moreover, as described further below, the two-stage process of the present invention can also be utilized in a single conduit dryer configuration, in which the injection chamber is used for injecting an external source of heated air into the stream of mixed air from the mixing chamber. Numerous sources of external heated air, described below, can be utilized for improving the performance and efficiency of industrial dryers.

Further details and advantages of the present invention will become readily apparent from the detailed description of the preferred embodiments that refers specifically to the following drawings.

DETAILED DESCRIPTION OF THE PREFERRED EMBODIMENTS

The present invention includes both a system and method for mixing fluid streams, particularly those associated with contemporary drying systems. As described below, the present invention solves a number of problems noted in the textiles, paper and non-wovens industries. Most notably, the present invention includes a significant redesign of the drying system that efficiently utilizes system air and mixes it with combustion products in order to produce uniformly heated air for the web of goods. The mixing efficiencies of the present invention allow for a compact dryer design that is more economical in terms of raw materials, energy and space utilization.

Figure 1:
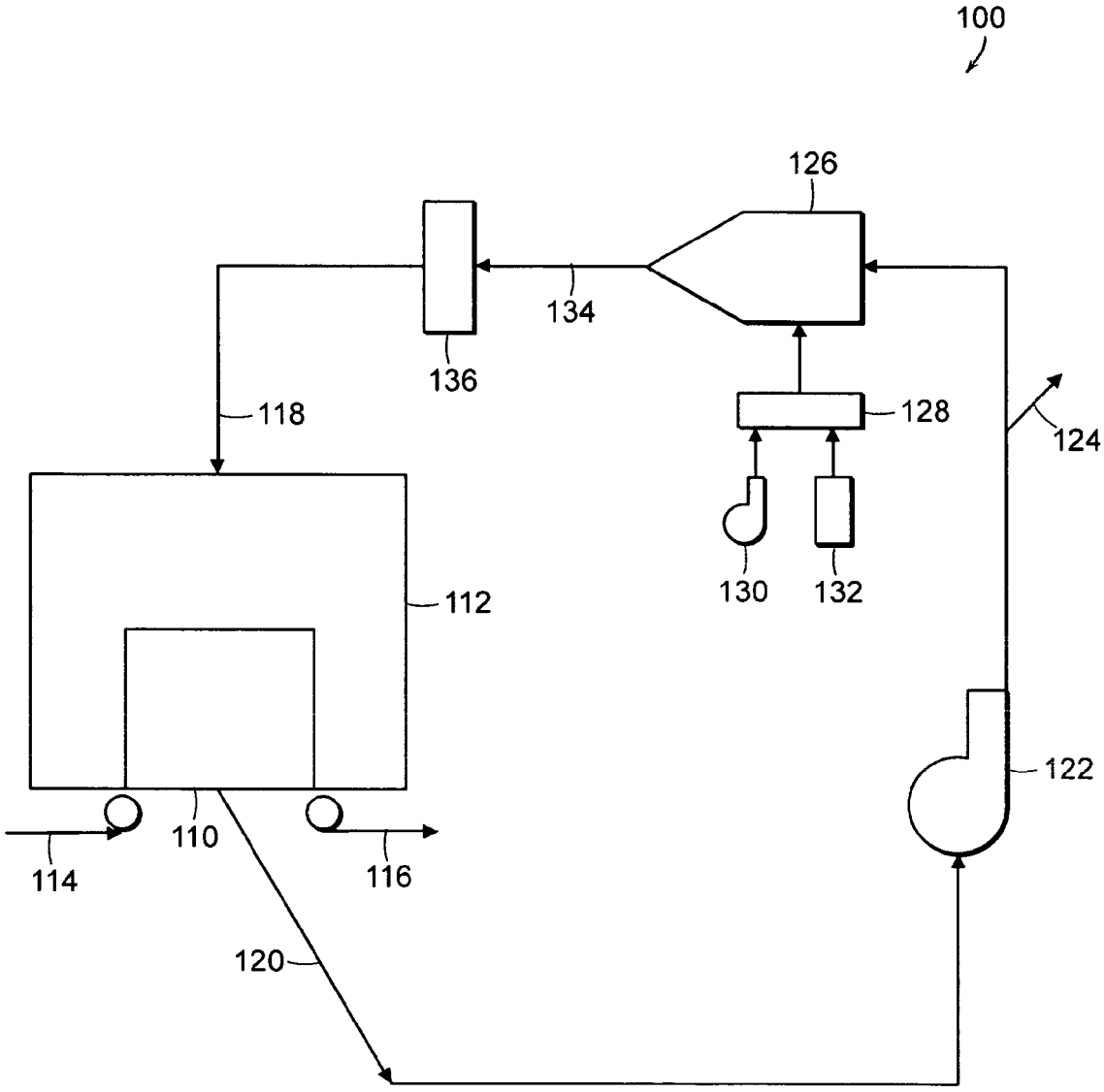
FIG. 1 is a schematic representation of a through-air-dryer system typical of the prior art.
Figure 2A:
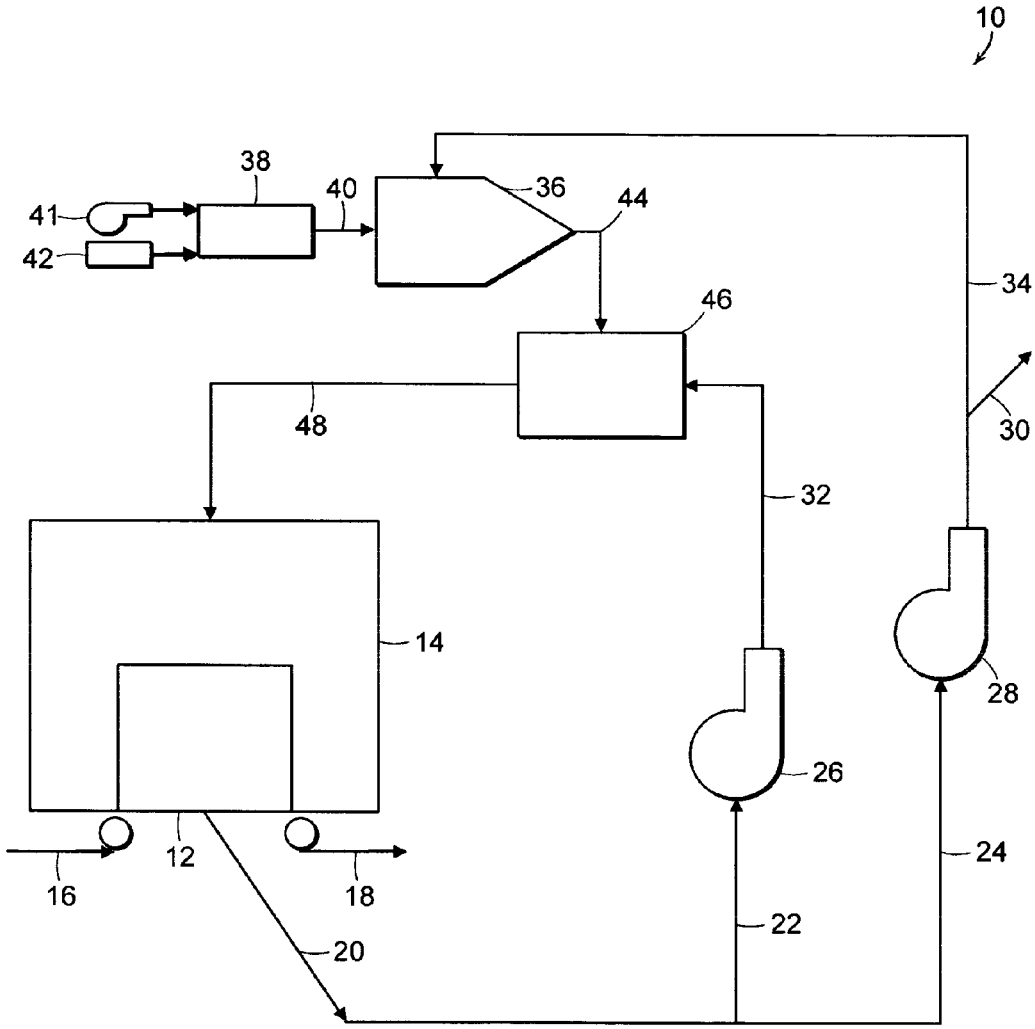
FIG. 2A is a schematic representation of a drying system in accordance with one embodiment of the present invention.

Turning to FIG. 2A, the system 10 for drying a textile web is shown. As shown, the system 10 is represented schematically, thus it should be understood that the novel features of the present invention are equally applicable to all types of industrial mixers, including at least TAD's, floatation dryers and Yankee impingement dryers, as well as any other dryer that uses heated air for drying goods. The system 10 includes a dryer 12 disposed within a drying hood 14. The dryer 12 is typically one of the aforementioned dryers commonly used for drying goods, although it should be understood that the present invention is operable with any and all kinds of dryers that utilize heated air. A web enters the drying hood 14 at a wet end 16 and exits the drying hood 14 at a dry end 18. As discussed in detail above, air drawn through an intake 48 passes through the dryer 12 and the drying hood 14 and is expelled through an exhaust 20, which is in turn coupled to a pair of parallel conduits that embody the system 10 of the present invention.

The exhaust 20 is coupled to a first air conduit 22 in circuitous communication with the exhaust 20 and the intake 48 and a second air conduit 24 in communication with the first air conduit 22. The air expelled through the exhaust 20 is referred to as system air, i.e. air that is not introduced from outside the system 10. The system air (not shown) is divided into a first portion 32 and a second portion 34, which are directed into the first conduit 22 and the second conduit 24, respectively.

A first fan 26 is part of the first air conduit 22 for receiving the first portion 32 of the system air and directing it through an injection chamber 46. A second fan 28 is part of the second air conduit 24 for receiving the second portion 34 of system air and directing it through to a mixing chamber 36. An exhaust port 30 is preferably disposed in the second conduit 24 for optionally expelling some of the second portion 34 of the system air into the atmosphere.

The mixing chamber 36 is adapted for receiving the second portion 34 of the system air and mixing it into combustion products 40 emanating from a burner 38, which is fed by a source of combustion air 41 and fuel 42. The combustion products 40 are too hot for direct introduction into the system 10. For example, the combustion products 40 may typically be between 1100 and 1550 degrees Celsius. Accordingly, the system 10 of the present invention introduces a two stage mixing process in order to efficiently temper the combustion products 40 into a readily usable stream of air heated to a range typically between 400 to 1500 degrees Celsius, i.e. a stream of mixed air 44.

The resulting mixed air 44 is directed towards the injection chamber 46, where it is injected back into the first portion 32 of the system air. After injection of the mixed air 44 into the first portion 32 of the system air, the intake 48 of the system 10 directs the uniformly profiled air into the dryer hood 14. The specific means for mixing and means for injection are discussed in detail below.

Figure 2B:
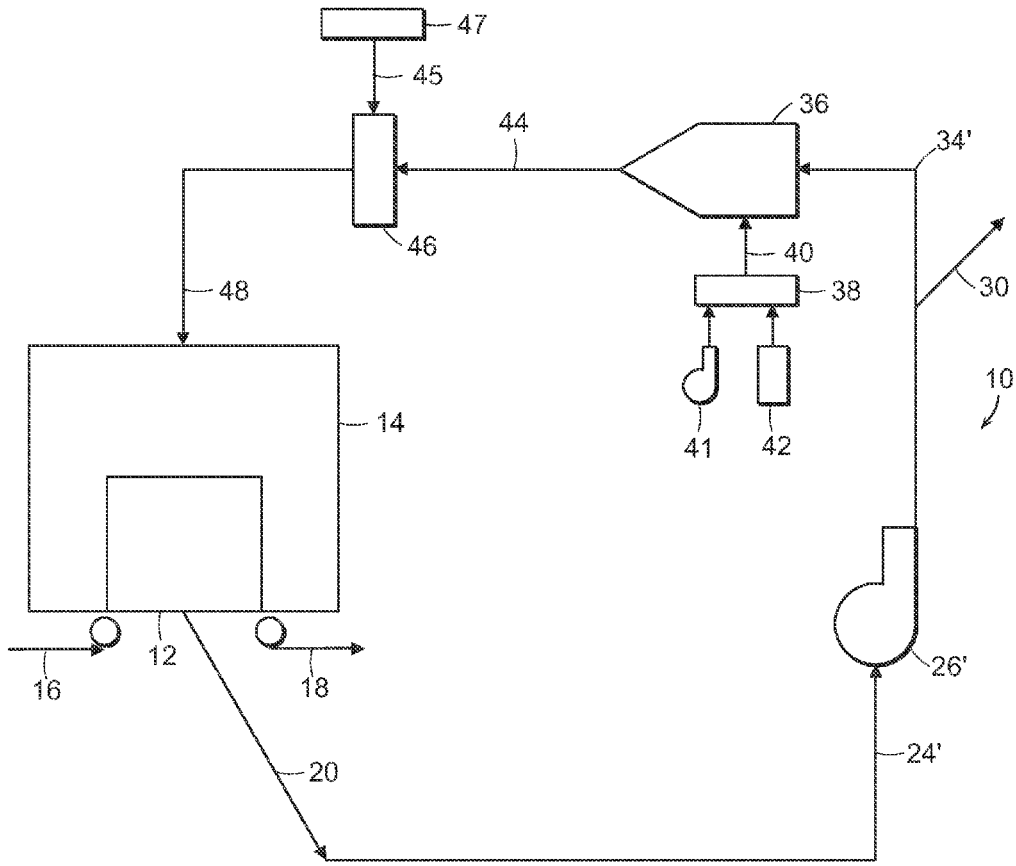
FIG. 2B is a schematic representation of a drying system in accordance with another embodiment of the present invention.

FIG. 2B is a schematic representation of another embodiment of the present invention, wherein identical reference numerals refer to similar elements as described with reference to FIG. 2A. As in the previous embodiment, the system 10 includes a dryer 12 disposed within a drying hood 14. The web enters the drying hood 14 at a wet end 16 and exits the drying hood 14 at a dry end 18. Air drawn through an intake 48 passes through the dryer 12 and the drying hood 14, from whence it is expelled through an exhaust 20. Unlike the prior embodiment, however, that shown in FIG. 2B has a single conduit for recycling the system air.

The exhaust 20 is coupled to a conduit 24', which is in circuitous communication with the exhaust 20 and the intake 48. The air expelled through the exhaust 20 is still referred to as the system air. The system air (not shown) consists solely of a portion 34', which is directed into the conduit 24', as noted above.

A fan 26' is part of the conduit 24' for receiving the portion 34' of system air and directing it through to a mixing chamber 36. An exhaust port 30 is preferably disposed in the conduit 24' for optionally expelling some of the portion 34' of the system air into the atmosphere.

As in the prior embodiment, the mixing chamber 36 is adapted for receiving the portion 34' of the system air and mixing it into combustion products 40 emanating from a burner 38, which is fed by a source of combustion air 41 and fuel 42. As previously noted, the combustion products 40 are too hot for direct introduction into the system 10. Thus the system 10 of the present invention introduces another two stage mixing process in order to efficiently temper the combustion products 40 into a readily usable stream of air heated to a typical range of 150 to 600 degrees Celsius referred to as the stream of mixed air 44.

The resulting mixed air 44 is directed towards the injection chamber 46, where it receives an injection of heated air 45 from an external source 47. For purposes of the present invention, the heated air 45 may include air that is heated by a turbine, a second burner, exhaust from the machinery of the system 10, as well as certain types of naturally occurring volumes of air, such as those derived from geothermal processes. Thus as defined herein, the term external source 47 should be understood to refer to a source of heated air that is not derived from a burner located within the system 10. For example, the external source 47 may be typified as waste heat from another process or heat from another, lower cost source. Accordingly, the burner 42 used in the present invention can be smaller and more fuel efficient, thereby reducing the overall space and energy consumption associated with heating the air. As in previous embodiments, after injection of the heated air 45 into the mixed air 44, the intake 48 of the system 10 directs the uniformly profiled air into the dryer hood 14.

Figure 3:
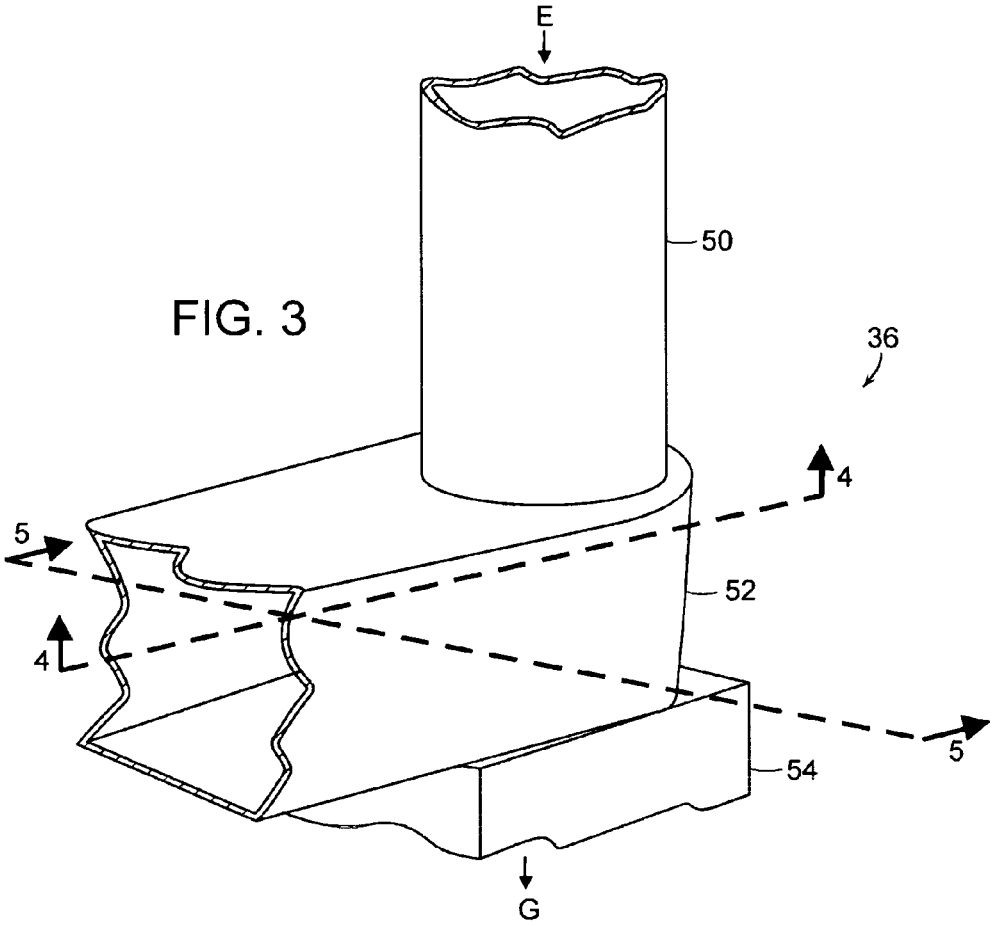
FIG. 3 is a perspective view of a mixing chamber of the drying system of the present invention.

FIG. 3 is a perspective view of the mixing chamber 36 of the system 10 of the present invention. The mixing chamber 36 includes a first passage 50 directing combustion product 40 from the burner 38, a second passage 52 carrying the second portion 34 of the system air, and a third passage 54 directing the mixed air 44 to the injection chamber 46. Preferably, the first passage 50 and second passage 52 are in fluid communication and oriented in an orthogonal manner, as shown in FIG. 3.

Figure 4:
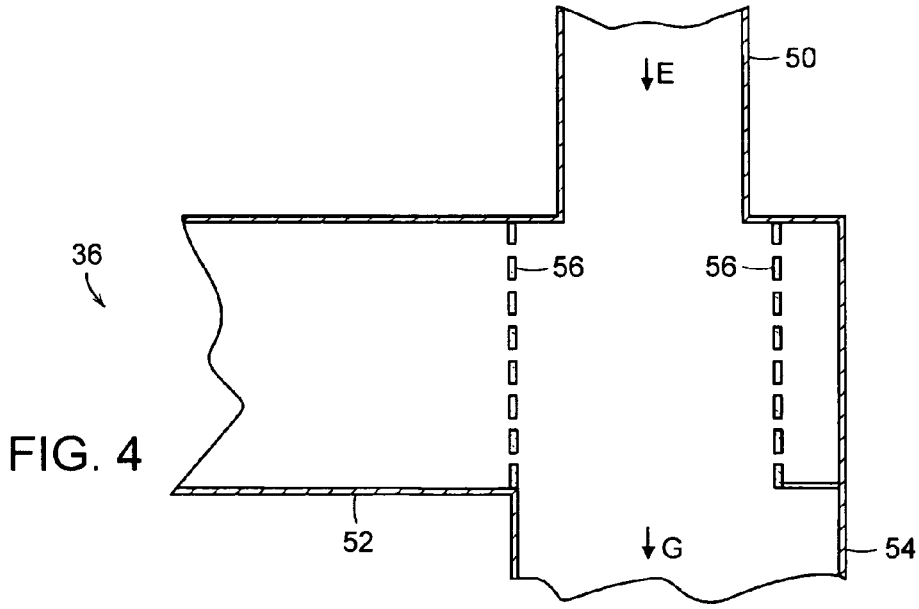
FIG. 4 is a cross-sectional view of the mixing chamber shown in FIG. 3 along line 5-5.
Figure 5:
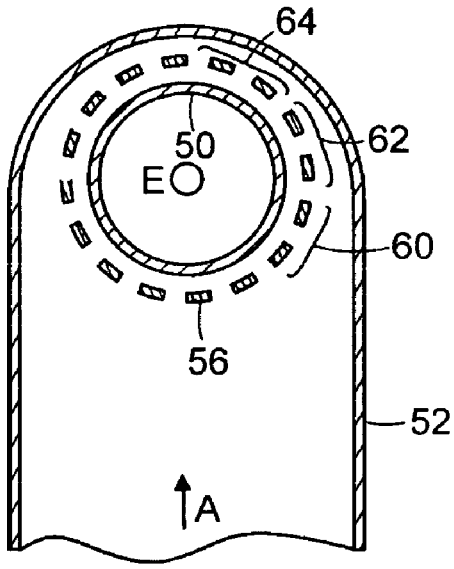
FIG. 5 is a cross-sectional view of the mixing chamber shown in FIG. 3 along line 4-4.

FIG. 4 is a cross-sectional view of the mixing chamber 36 shown in FIG. 3 along line 4-4. As shown, the mixing chamber 36 is preferably outfitted with a perforated sleeve 56 that selectively places air from the second portion 34 in fluid contact with the combustion product 40 that is traveling through the first passage 50. In the cross-sectional view along line 5-5 shown in FIG. 5, the first passage 50 has a circular cross-section. The second passage 52 terminates near the intersection between it and the first passage 50, and the perforated sleeve 56 is disposed between the respective passages.

A volume is defined between the perforated sleeve 56 and the interior surface of the second passage 52, and the second portion 34 of the system air must of course occupy this volume as it passes through the perforated sleeve 56. In a preferred embodiment, the volume so defined is variable about the perforated sleeve 56, such that the pressure gradient along the surface of the perforated sleeve 56 will also be variable. For example, a volume along section 60 is greater than a volume along section 62, which in turn is greater than a volume along section 64. By varying the volume defining the intersection between the combustion product 40 and the second portion 34 of the system air, the designers can tailor the mixing rate of the two fluid streams as they form the mixed air 44.

Figure 6:
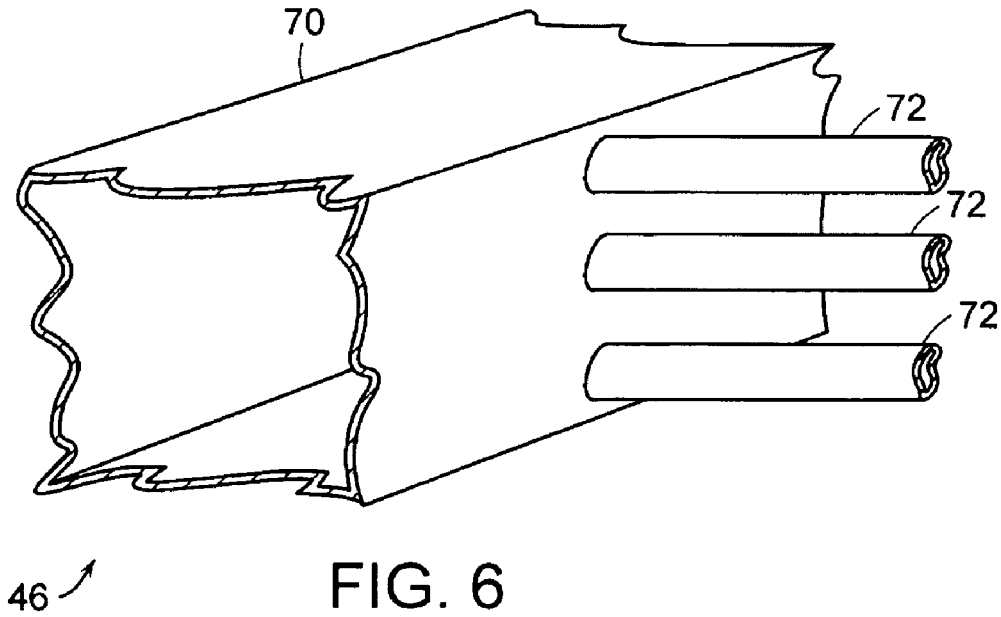
FIG. 6 is a perspective view of an injection chamber of the through-air-dryer system of the present invention.

FIG. 6 is a perspective view of an injection chamber 46 of the drying system of the present invention. The injection chamber 46 includes a third passage 70 for directing the first portion 32 of the system air. The third passage 70 is intersected by at least one injector 72 that directs the mixed air 44 into the first portion 32 of the system air. The means for injection are described in full detail below in conjunction with alternative embodiments of the system 10.

Figure 7:
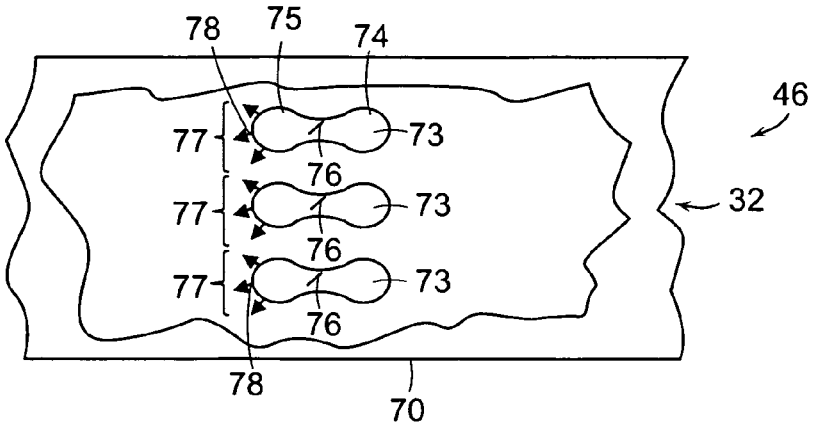
FIG. 7 is a partial cut-away plan view of the injection chamber shown in FIG. 6 in accordance with one embodiment of the present invention.
Figure 8:
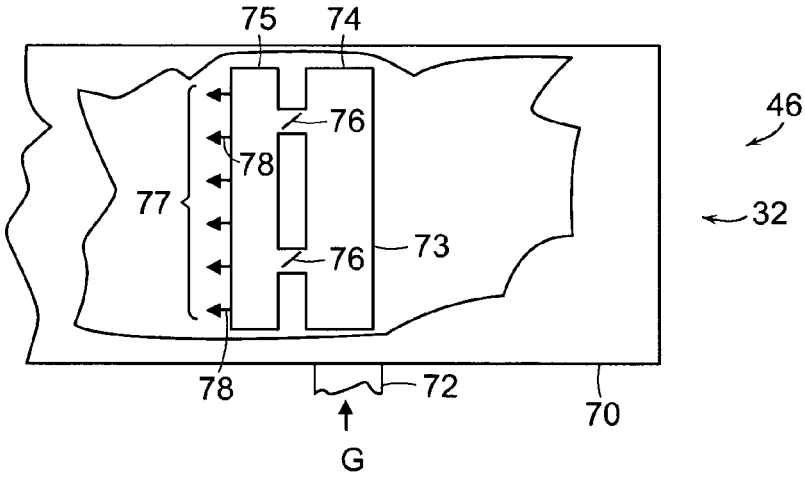
FIG. 8 is a partial cut-away side view of the injection chamber shown in FIGS. 6 and 7 in accordance with one embodiment of the present invention.

FIG. 7 is a partial cut-away plan view of the injection chamber 46 shown in FIG. 6 in accordance with one embodiment of the present invention. FIG. 8 is a partial cut-away side view of the injection chamber 46. As shown in FIGS. 7 and 8, an arrow pointing leftwards represents the first portion 32 of system air. Each of the injectors 72 includes a projection 73, which in the embodiment shown is defined by a first tubular portion 74 and a second tubular portion 75. The injectors 72 are arranged orthogonal to the flow of the first portion 32 of system air, which is to say that they are also orthogonal to the third passage 70 described above.

The first tubular portion 74 and second tubular portion 75 cooperate to define an obtuse structure in the third passage 70 so as to create pockets of low pressure 77 in the flow of the first portion 32 of system air. The projections 73 defined by the first tubular portion 74 and second tubular portion 75 are purposefully obtuse in order to maximize the turbulence in the airflow and thereby induce mixing between the mixed air 44 and the first portion 32 of system air. A plurality of ports 78 (depicted as small arrows) are defined on the second tubular portion 75 for transmitting the mixed air 44 into the pockets of low pressure 77. The flow of mixed air 44 into the third passage 70 is controlled by at least one throttle valve 76 disposed between each of the first tubular portions 74 and second tubular portions 75. The throttle valves 76 are controllable by a system operator either mechanically or electronically, depending upon the configuration of the system 10.

Figure 9:
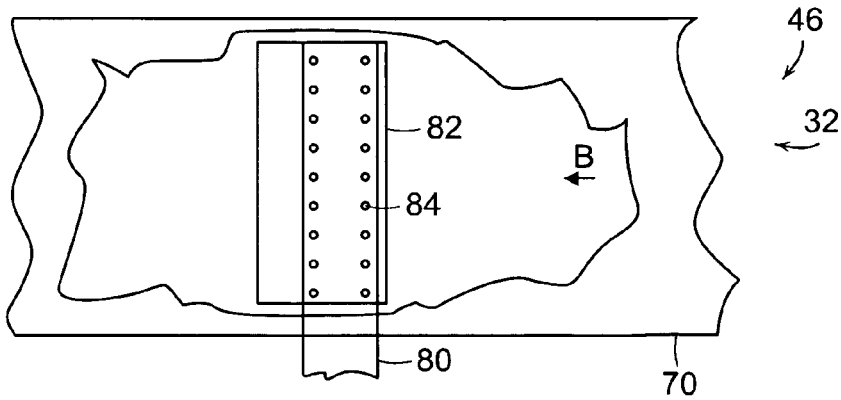
FIG. 9 is a partial cut-away side view of the injection chamber shown in FIG. 6 in accordance with another embodiment of the present invention.
Figure 10:
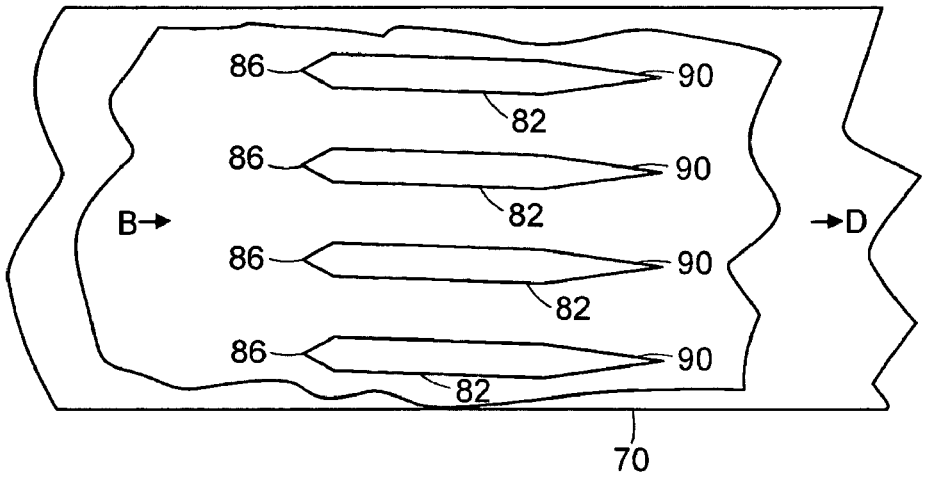
FIG. 10 is a partial cut-away plan view of the injection chamber shown in FIG. 9.
Figure 11:
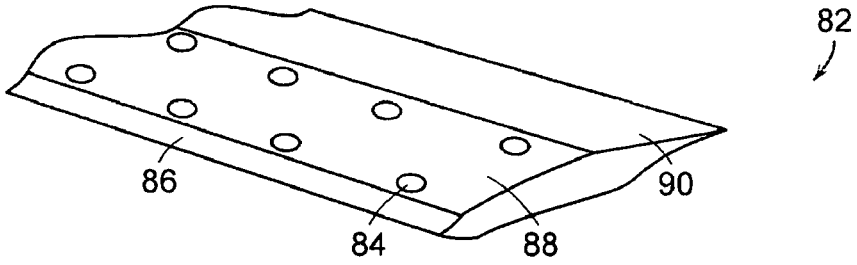
FIG. 11 is a perspective view of a partial manifold of the injection chamber in accordance with the present invention

FIG. 9 is a partial cut-away side view of the injection chamber shown in FIG. 6 in accordance with another embodiment of the present invention. As shown, the injector 80 includes a manifold 82 having a plurality of nozzles 84 disposed thereon. FIG. 10 is a partial cut-away plan view of the injection chamber shown in FIG. 9 better demonstrating the aerodynamic properties of the manifolds 82, and FIG. 11 is a perspective view of a partial manifold 82 of the injection chamber 46. Each manifold 82 defines a leading edge 86, a central portion 88 that includes the nozzles 84, and a trailing edge 90. As used herein, the terms leading and trailing refer to the standard orientation of an object in a fluid stream, i.e. the leading edge 86 is the first edge to contact the fluid, while the trailing edge 90 serves to smooth out any turbulence in the fluid.

Figure 12:
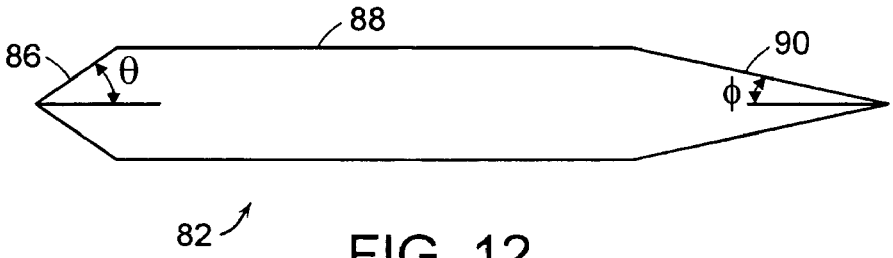
FIG. 12 is a cross-sectional view of the manifold of the injection chamber in accordance with the present invention.

FIG. 12 is a cross-sectional view of the manifold 82 of the injection chamber 46 in accordance with the present invention. As shown, the nozzles 84 are disposed on the surface of the central portion 88 for directing a fluid in a direction normal to the surface of the central portion 88. In particular, the nozzles 84 are configured for injecting the mixed air 44 into the first portion 32 of the system air. The aerodynamic profile of the manifolds 82, as detailed in FIG. 12, creates small-scale turbulence in the air stream, as opposed to the large pressure drop described above with respect to the obtuse projections 73. In particular, for each manifold the surface of the leading edge 86 defines an angle $\theta$ relative to the central portion 88 and the trailing edge 90 defines an angle $\phi$ relative to the central portion 88. In preferred embodiments, the angle $\theta$ is less than twenty degrees, and is most preferably less than fifteen degrees for optimum aerodynamics. The angle $\phi$ is preferably less than twelve degrees, and is most preferably less than eight degrees.

As the manifolds 82 described herein are specifically designed to reduce turbulence in the system 10, the only turbulence created in a manifold-style injection chamber 46 is by the injection of the mixed air 44 into the first portion 32 of system air through the nozzles 84. It follows that in order to maximize the mixing activity of the two streams, each manifold 82 must have a number of nozzles 84 disposed thereon, preferably arranged in multiple rows and on both surfaces of the central portion 88. As the nozzle velocity of each nozzle 84 can be optimized for variable conditions, a system operator can fine-tune the mixing performance of the injection chamber 46 for particular needs.

One particular benefit of the manifold approach to fluid injection is that the temperature profile of the air entering the intake 48 can be readily controlled using a control loop for varying the injection rate of the manifolds 82. This increased control over the air profile near to or within the drying hood 14 allows for customized and optimized temperature control, which in turn permits engineers and manufacturers to develop improved goods at lower costs. Control over the manifolds 82 is precise enough that it is possible to dispose the injection chamber 46 close to, or even integrated into, the intake 48 of the drying hood 14. In particular, electronic control over the manifolds 82 permits a manufacturer to locate the injection chamber 46 at any point in the system 10 that is downstream from the mixing chamber 36, including of course integrating the injection chamber 46 into the drying hood 14.

Figure 13:
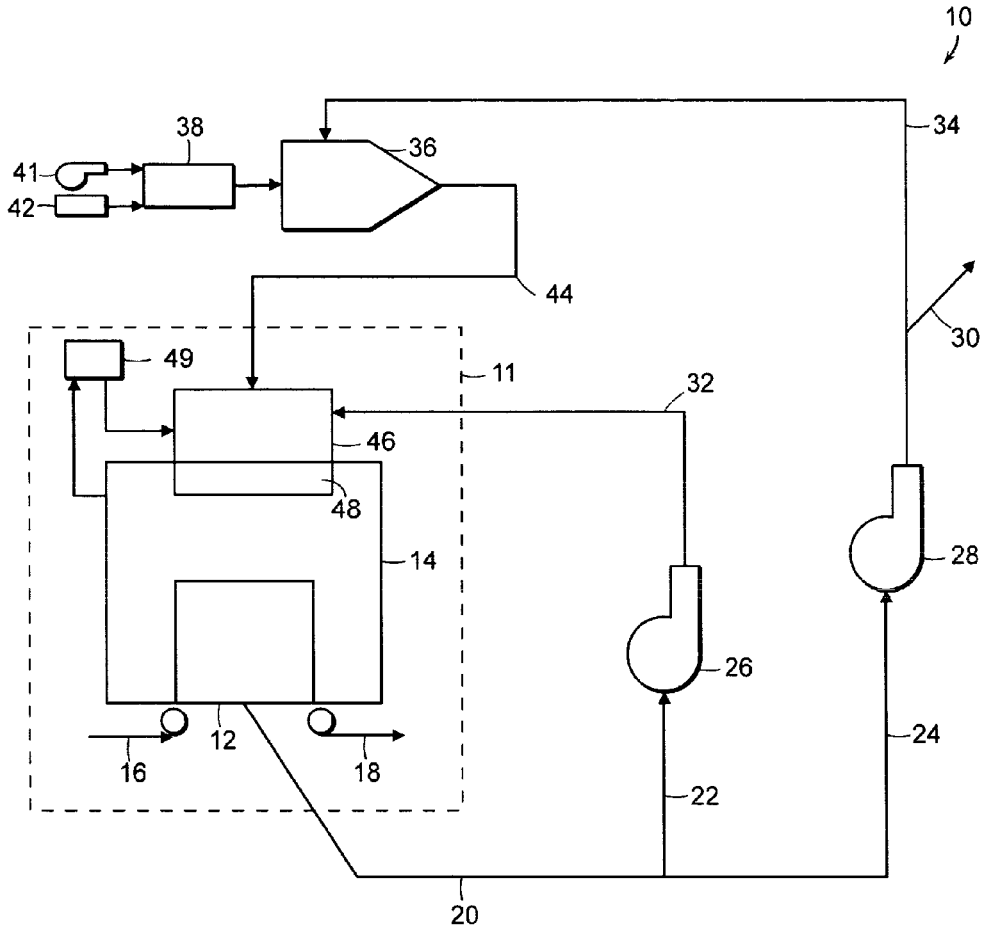
FIG. 13 is a schematic diagram of a dryer system having an integrated injection chamber in accordance with one embodiment of the present invention.

By way of example, FIG. 13 is a schematic diagram of a dryer system 10 having an integrated injection chamber 11 in accordance with one embodiment of the present invention. While similar reference numerals refer to similar elements, the system configuration shown in FIG. 13 illustrates an injection chamber 46 integrated into the drying hood 14. A controller 49 is coupled to the drying hood 14 and the injection chamber 46, and is preferably configured to receive feedback signals from the drying hood 14 in order to monitor and adapt the nozzle velocity of the manifolds 82 of the injection chamber 46. The manifolds 82 of the injection chamber 46 can be controlled to create particular temperature profiles in the drying hood 14 in both the machine and cross-machine directions. Moreover, the controller 49 can be adapted to provide instantaneous response from the feedback signals, thus providing an effective bias against unwanted variations in the temperature profile of the hood.

Figure 14:
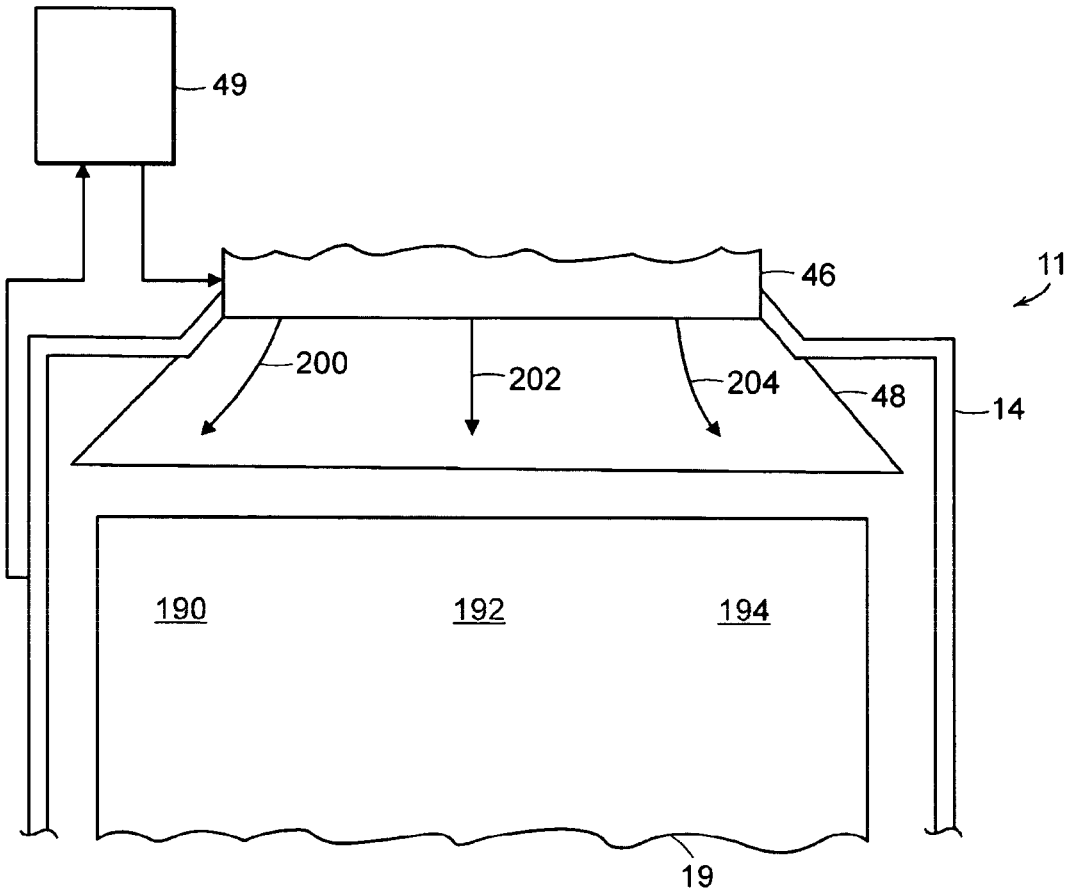
FIG. 14 is a partial cut-away view of a dryer hood having an integrated injection chamber in accordance with one embodiment of the present invention.

FIG. 14 is a partial cut-away view of a dryer hood 14 having an integrated injection chamber illustrating the precision and capabilities of the aspect of the invention described above. A web 19 of material is shown disposed within the hood 14. The web 19 defines three zones of differing dryness, a first zone 190, a second zone 192 and a third zone 194. The injection chamber 46 and intake 48 are integrated into the drying hood 14 and disposed in close proximity to the web 19. The controller 49 receives signals indicative of the dryness/temperature or alternative measurement of the web, and in response to those signals directs the manifolds 82 within the injection chamber 46 to respond in an appropriate fashion.

For example, the manifolds 82 within the injection chamber 46 can be controlled to produce three streams of differing temperature, a first stream 200, a second stream 202 and a third stream 204. The nature of the feedback through the controller 49 ensures that the first stream 200 corresponds to the first zone 190, the second stream 202 to the second zone 192, and the third stream 204 to the third zone 204. Accordingly, the integration of the injection chamber 46 not only provides means for homogenizing the air temperature within the drying hood 14, it also provides means for biasing the air temperature within the drying hood 14 in a manner that is readily controllable. That is, the injection chamber 46 can be biased to inject hot air into an area correlating with a wet portion of the web 19, and conversely, the injection chamber 46 can be controlled to inject cooler air towards a dryer portion of the web 19. In short, by integrating the injection chamber 46 into the drying hood 14, the present invention enables users to optimize the drying of the web 19 in the most efficient manner.

The benefits of the present invention, in particular those achieved through the control over the manifolds 82 as well as the integration of the injection chamber 46 into the drying hood 14, result from the two-stage mixing processes described in detail above, which in turn reduces the length of the conduits necessary to direct the first portion 32 of the system air. Moreover, the usage of an external source, such as heated air from an ancillary process or machine, further lessens the costs associated with heating a uniform stream of air. As illustrated above, the present invention will enable engineers and designers to manufacture industrial dryers that utilize this process, which in turn will increase the drying efficiency of any number of commercial operations.

While the present invention has been described in detail with respect to its preferred embodiments, these should be understood to be exemplary in nature and not limiting as to the scope of the present invention. It is certain that design modifications could be readily devised by those skilled in the art, and that any such modifications would fall within the scope of the present invention as defined herein by the following claims.

We claim:

1. A system for drying a traveling web of goods comprising:

a) a dryer receiving air through an intake and expelling system air through an exhaust;

b) a single air conduit in circuitous communication with the exhaust and the intake, the air conduit receiving the system air and directing it to the intake;

c) an injection chamber disposed in fluid communication with the single air conduit, the injection chamber adapted for injecting a stream of hot air from an external heat source into the single air conduit;

d) an external heat source coupled to the injection chamber and external to the system and e) a mixing chamber disposed in fluid communication with the single air conduit, wherein:

i) the mixing chamber receives heated air from a burner and mixes the heated air with the system air to form mixed air, ii) the mixing chamber includes a first passage directing combustion product from the burner and a second passage directing the system air, the first passage and second passage in fluid communication such that the system air is heated by the combustion product, iii) the mixing chamber is disposed serially relative to the injection chamber such that air processed through the mixing chamber is directed through the injection chamber, iv) the injection chamber comprises a portion of the single air conduit and one or more injectors for injecting hot air from an external source into the portion of the single air conduit for mixing with the mixed air, v) the injector comprises a projection projecting into the single air conduit such that the projection disrupts the airflow of the mixed air thereby creating a uniform temperature profile of air directed into the dryer intake, and vi) the projection is oriented substantially orthogonal to the flow of the system air.

2. The system of claim 1 further comprising a fan coupled to the single air conduit.

3. The system of claim 1 further comprising an exhaust port coupled to the single air conduit.

4. The system of claim 1 further comprising a fuel source coupled to the burner, the fuel source providing combustible fuel to the burner.

5. The system of claim 1 wherein the first passage and the second passage are oriented in an orthogonal manner.

6. The system of claim 1 further comprising a perforated sleeve disposed about the first passage.

7. The system of claim 6 wherein the perforated sleeve is disposed within the second passage in an orthogonal manner.

8. The system of claim 7 wherein the second passage and the perforated sleeve cooperate to define a volume about the perforated sleeve.

9. The system of claim 8 wherein the volume defined by the second passage and the perforated sleeve is variable about the perforated sleeve.

10. The system of claim 8 wherein the perforated sleeve is substantially circular in cross-section.

11. The system of claim 1 wherein the injection chamber includes means for injecting air from the mixing chamber into the portion of the single air conduit.

12. The system of claim 1 wherein the projection comprises a manifold adapted to receive air from the mixing chamber and further adapted to distribute air into the conduit.

13. The system of claim 12 further comprising a nozzle integrated into the manifold for distributing air into the single air conduit.

14. The system of claim 13 wherein the nozzle is selectively actuated for distributing variable amounts of air into the single air conduit.

15. The system of claim 13 further comprising at least a second nozzle integrated into the manifold for distributing air into the single air conduit.

16. The system of claim 12 wherein the manifold defines a leading edge, a central portion, and a trailing edge.

17. The system of claim 16 wherein the central portion of the manifold defines a central portion surface that is substantially parallel to the flow of the first portion of system air.

18. The system of claim 17 further comprising a leading edge surface that defines an angle relative to the central portion surface.

19. The system of claim 18 wherein the angle between the leading edge surface and the central portion surface is less than fifteen degrees.

20. The system of claim 17 further comprising a trailing edge surface that defines an angle relative to the central portion surface.

21. The system of claim 20 wherein the angle between the trailing edge surface and the central portion surface is less than eight degrees.

* * * * *